US010553384B1

(12) United States Patent
Chiu

(10) Patent No.: US 10,553,384 B1
(45) Date of Patent: Feb. 4, 2020

(54) ANTI-SURGE WINDING FUSIBLE RESISTOR FUSE

(71) Applicant: CONQUER ELECTRONICS CO., LTD., Taipei (TW)

(72) Inventor: Hung-Chih Chiu, Taipei (TW)

(73) Assignee: CONQUER ELECTRONICS CO., LTD., Taipei (TW)

( * ) Notice: Subject to any disclaimer, the term of this patent is extended or adjusted under 35 U.S.C. 154(b) by 0 days.

(21) Appl. No.: 16/392,628

(22) Filed: Apr. 24, 2019

(51) Int. Cl.
*H01H 85/048* (2006.01)
*H01H 85/02* (2006.01)
*H01F 27/40* (2006.01)
*H01C 3/14* (2006.01)

(52) U.S. Cl.
CPC ..... *H01H 85/048* (2013.01); *H01C 3/14* (2013.01); *H01F 27/402* (2013.01); *H01H 85/0241* (2013.01); *H01H 2085/0483* (2013.01)

(58) Field of Classification Search
CPC ..... H01H 85/048; H01H 85/0241; H01H 2085/0483; H01F 27/402; H01C 3/14
USPC ..... 337/140, 150, 395
See application file for complete search history.

(56) References Cited

U.S. PATENT DOCUMENTS 3,735,318 A * 5/1973 Bucklin ..... H01H 85/046 337/296
3,836,883 A * 9/1974 Takayasu ..... H01H 85/046 337/163
4,047,143 A * 9/1977 Burden ..... H01H 85/36 337/239
5,621,602 A * 4/1997 Winkelmann ..... H01H 85/048 337/184
5,844,761 A * 12/1998 Place, IV ..... H01H 85/048 361/104
8,654,497 B2 * 2/2014 El Filali ..... H01C 7/13 361/103
10,347,402 B1 * 7/2019 Du ..... H01C 1/14
2015/0262775 A1 * 9/2015 Kang ..... H01H 37/04 337/414
2016/0086757 A1 * 3/2016 Xu ..... H01H 85/055 337/183
2017/0237319 A1 * 8/2017 Qin ..... H02K 11/27 310/68 B
2018/0160538 A1 * 6/2018 Naito ..... H01C 1/02
2018/0254163 A1 * 9/2018 Lee ..... H01C 17/04

* cited by examiner

*Primary Examiner* — Jayprakash N Gandhi
*Assistant Examiner* — Stephen S Sul
(74) *Attorney, Agent, or Firm* — Leong C. Lei

(57) ABSTRACT

An anti-surge winding fusible resistor fuse includes: a first column, in combination with a first cap, a first fuse wire wound around the first column at intervals and in combination with the first cap; a second fuse wire, coated on a second column in combination with the first column; a first ring, configured on a contact of the first column with the second fuse wire, and the first fuse wire in combination with the first ring; an insulation body, in combination with the second fuse wire; a third column, in combination with the insulation body and a second cap, a third fuse wire wound around the third column at intervals and in combination with the second cap; and a second ring, covered on the second fuse wire, insulation body and third column, and the third fuse wire in combination with the second ring.

4 Claims, 5 Drawing Sheets

ANTI-SURGE WINDING FUSIBLE RESISTOR FUSE

(a) TECHNICAL FIELD OF THE INVENTION

The present invention relates to a fuse resistor, and more particularly to an anti-surge winding fusible resistor fuse having a thermal insulation structure and second fuse wire.

(b) DESCRIPTION OF THE PRIOR ART

Protection circuits are often used in electronic circuits to isolate a failing circuit from other circuits. For example, the protection circuit can be used to avoid the cascade failure of a circuit module in an electronic vehicle engine controller; it can also be used against more serious problems such as fire caused by power supply circuit failure.

The second fuse wire is one of the above types of protection circuits. The role of the second fuse wire is similar to typical glass fuse. Namely, the fuse behaves the same as a short circuit under normal operating conditions, and like an open circuit in failure conditions. When the temperature of the second fuse wire exceeds a specific temperature, the second fuse wire then switches between the two operation modes. To facilitate these modes, the second fuse wire will include a conduction element such as a fusible wire, a group of metal contacts, or a group of welded metal contacts capable of being switched from a conductive state to a non-conductive state; in the design thereof, it may be integrated with an inductive element, the physical state of which may be changed with its temperature. For example, the induction element may be equivalent to a low melting point metal alloy or discrete molten organic compound which will melt at an actuating temperature. When the state of the induction element is changed, the conduction element will then switch to the non-conductive state by the actual interruption of power conduction path.

In operation, the current will flow through the fuse element, the state of the induction element will be changed to allow the conduction element to be switched from the conductive state to the non-conductive state once the conduction element reaches the specified temperature.

The disadvantages of the second fuse wire is in that the second fuse wire must be configured very carefully to avoid the second fuse wire reaching the temperature at which the state of the inductive element is changed. In addition, the heat loss must also be avoided; heat is not concentrated enough or is lost too much, so that the second fuse wire cannot accurately determine the start-up time.

SUMMARY OF THE INVENTION

To overcome the disadvantages mentioned above, the present invention proposes an anti-surge winding fusible resistor fuse, including: a first column, one end thereof in combination with a first cap and wound around with a first fuse wire at intervals, one end of the first fuse wire in combination with the first cap; a second fuse wire, coated on an outer side of a second column, the second column in combination with another end of the first column; a first ring, configured on a contact of the first column with the second fuse wire, another end of the first fuse wire in combination with the first ring; an insulation body, in combination with another end of the second fuse wire; a third column, one end thereof in combination with another end of the insulation body, another end of the third column in combination with a second cap, the third column wound around with a third fuse wire at interval, and one end of the third fuse wire in combination with the second cap; and a second ring, configured on outsides of contacts of the insulation body with the second fuse wire and with the third column, another end of the third fuse wire in combination with the second ring.

The present invention has the following advantages: the insulation body can gather heat, increase the sensitivity of the second fuse wire, and accurately start at a preset temperature to achieve a protective effect, and the second fuse wire is positioned between the first column and third column, shaped like a traditional glass tube fuse.

DETAILED DESCRIPTION OF THE PREFERRED EMBODIMENTS

Figure 1:
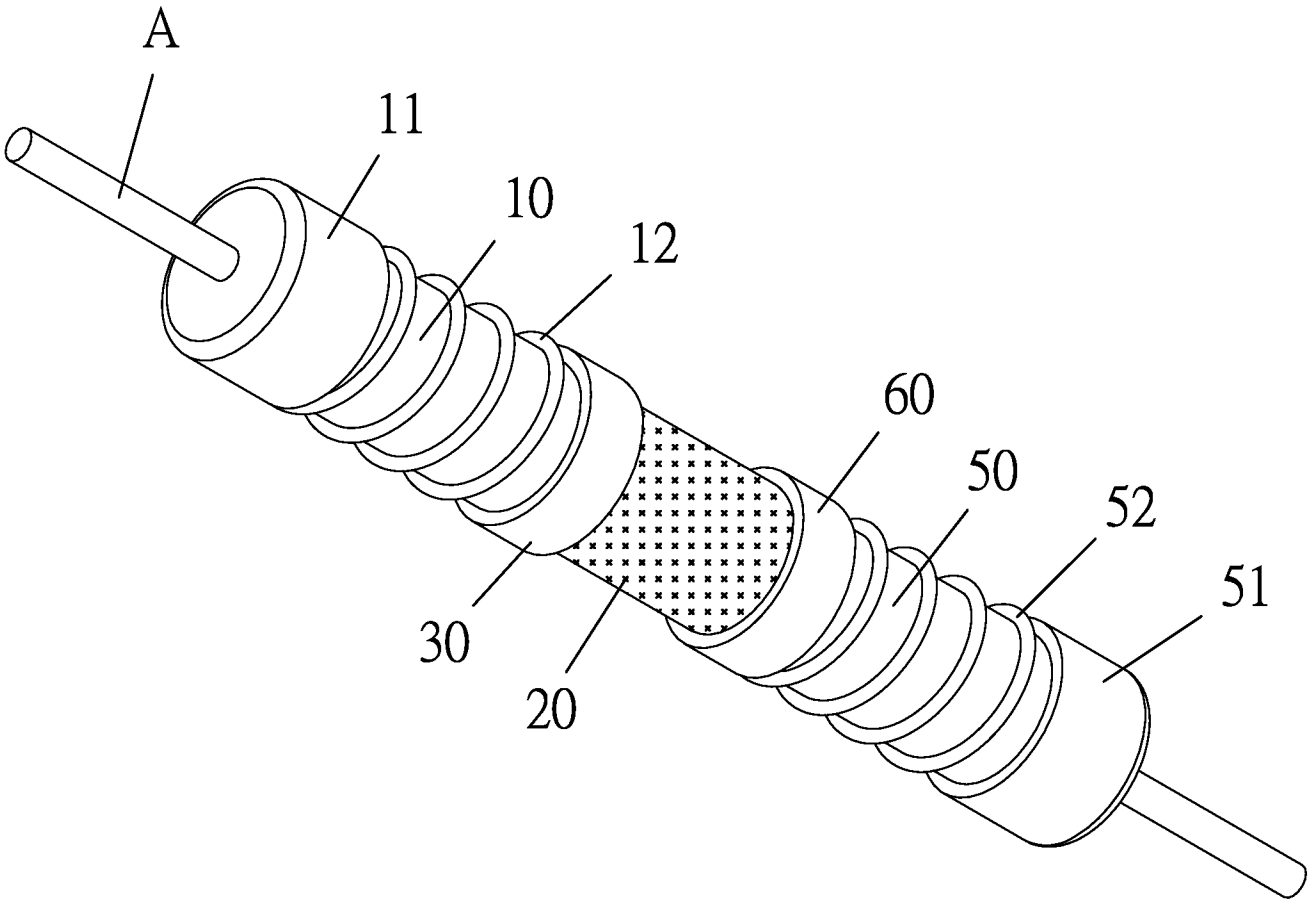
FIG. 1 is a perspective view of a first preferred embodiment of the present invention.
Figure 2:
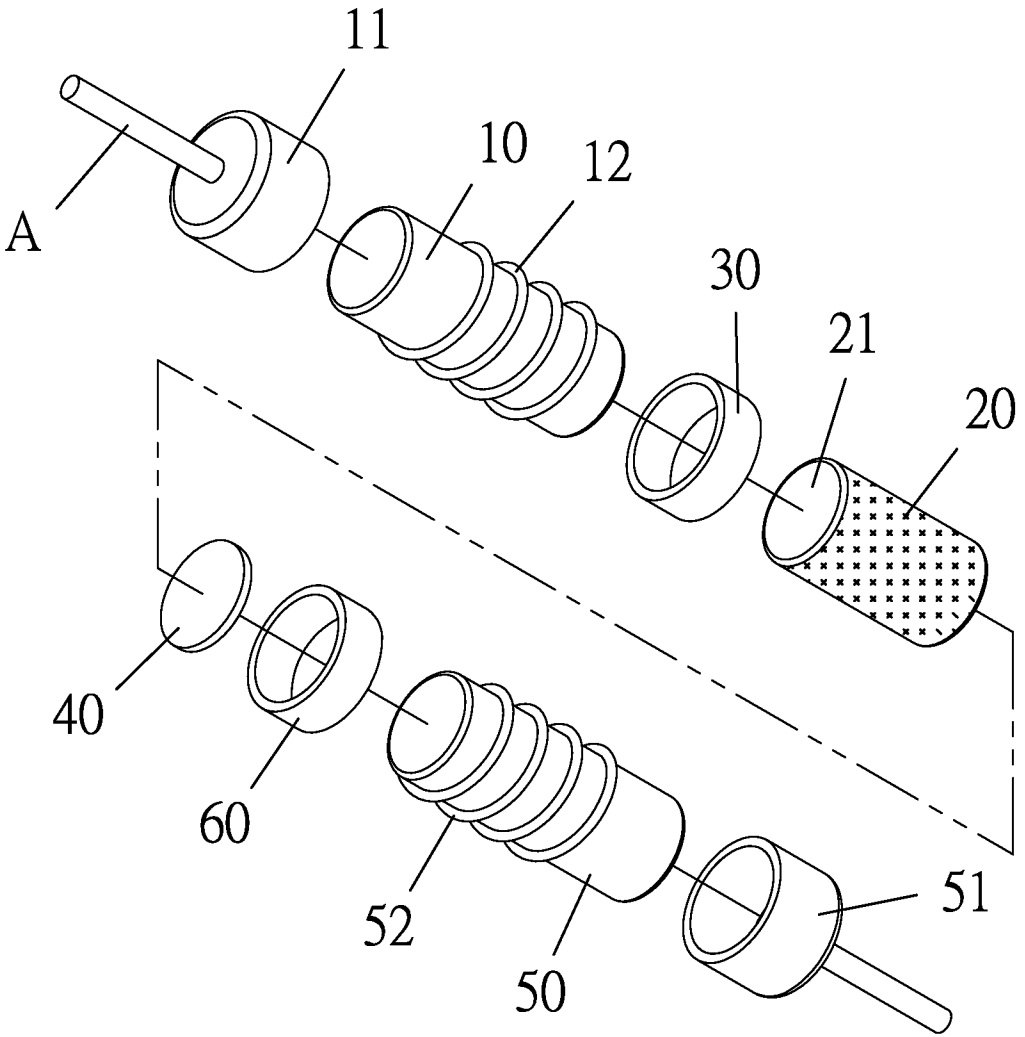
FIG. 2 is an exploded view of the first embodiment of the present invention.

Referring to FIGS. 1 and 2, an anti-surge winding fusible resistor fuse of the present invention includes a first column 10, second fuse wire 20, first ring 30, insulation body 40, third column 50 and second ring 60.

Figure 3:
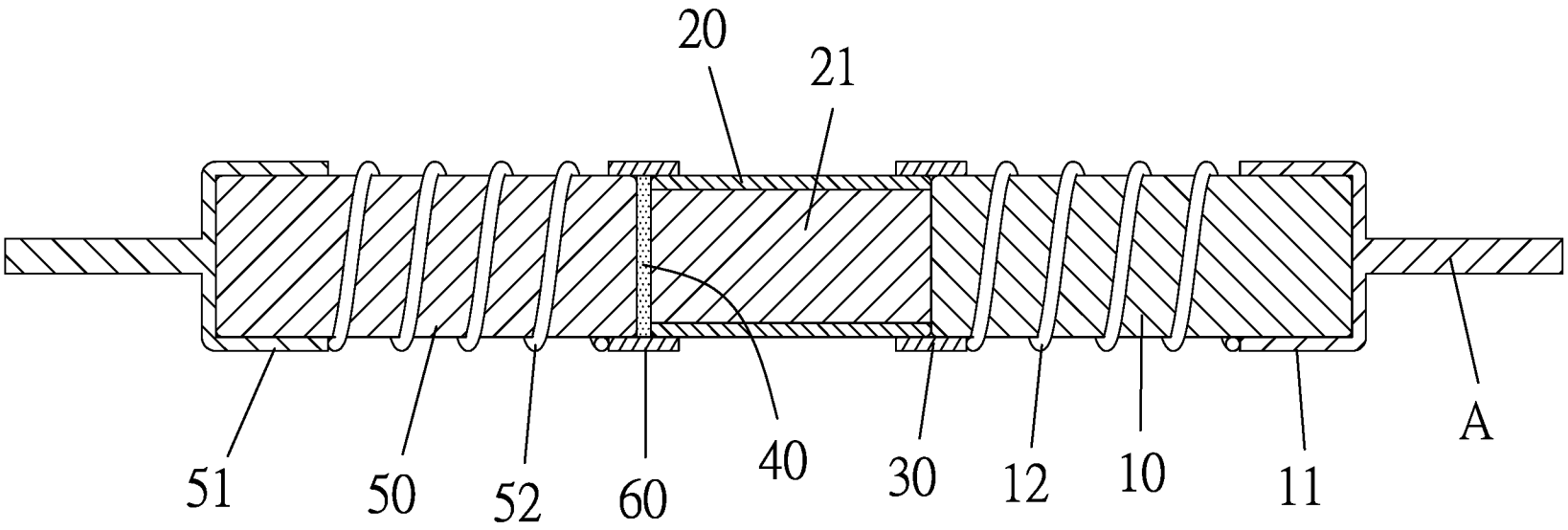
FIG. 3 is a cross-sectional view of the first embodiment of the present invention.

Referring to FIGS. 2 and 3, one end of the first column 10 is in combination with a first cap 11, and the first column 10 is wound around with a first fuse wire 12 at intervals, one end of which is in combination with the first cap 11.

The second fuse wire 20 is coated on the outside of a second column 21, where the second column 21 is in combination with another end of the first column 10.

The first ring 30 configured on the outside of the contact of the first column 10 with the second fuse wire 20

The insulation body 40 is in combination with another end of the second column 21 of the second fuse wire 20.

One end of the third column 50 is in combination with another end of the insulation body 40, and another end thereof a second cap 51, where the third column 50 is wound around with a third fuse wire 52 at intervals, one end of which is in combination with the second cap 51.

The melting point of the second fuse wire 20 is lower than that of the first fuse wire 12.

The outer sides of the first cap 11 and second cap 51 are respectively configure with a conducting wire A.

The second ring 60 is configured on the outsides of the contacts of the insulation 40 with the second fuse wire 20 and with the third column 50, and another end of the third fuse wire 52 is in combination with the second ring 60.

The present invention further has a covering layer (not shown in the figures) adapted to cover the first column 10, first cap 11, second fuse wire 20, first ring 30, insulation body 40, first column 50, second cap 51 and second ring 60, and each conducting wire A is extended out of the covering layer.

The present invention is characterized in that the insulation boy can gather heat, increase the sensitivity of the second fuse wire 20, and accurately start at a preset temperature to achieve a protective effect, and the second fuse wire 20 is positioned between the first column 10 and third column 50, shaped like a traditional glass tube fuse.

Figure 4:
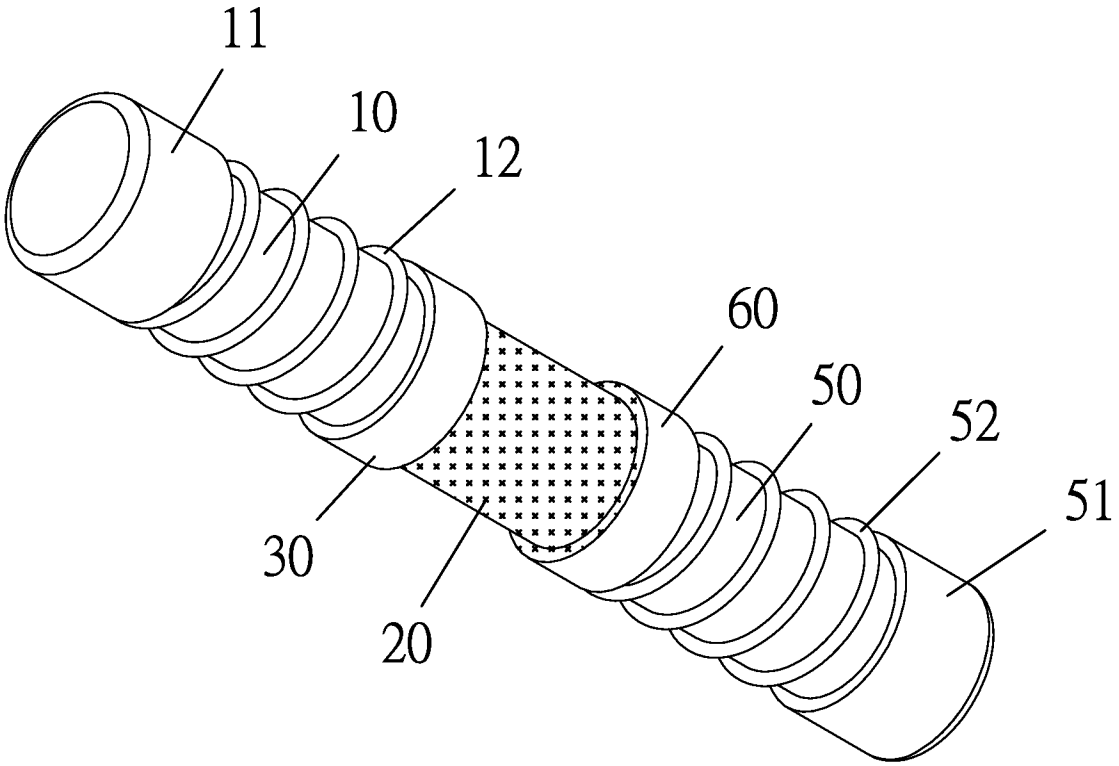
FIG. 4 is a perspective view of a second preferred embodiment of the present invention.
Figure 5:
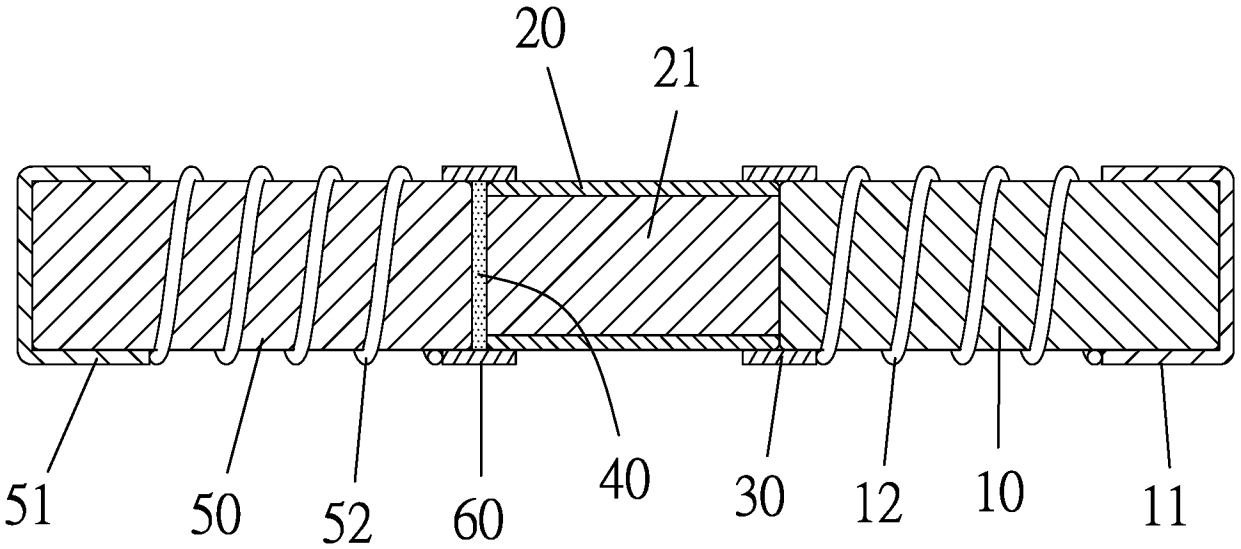
FIG. 5 is a cross-sectional view of the second embodiment of the present invention.

Referring to FIGS. 4 and 5, the first column 10, first cap 11, second fuse 20, first ring 40, insulation body 40, third column 50, second cap 51 and second ring 60 are packaged by means of surface-mount technology (SMD), and the present invention is not so limited.

I claim:

1. An anti-surge winding fusible resistor fuse, comprising:

a first column, one end thereof coupled to a first cap and wound around with a first fuse wire at intervals, one end of said first fuse wire coupled to said first cap;

a second fuse wire, coated on an outside of a second column, said second column coupled to another end of said first column;

a first ring provided on said first column with said second fuse wire, another end of said first fuse wire coupled to said first ring;

an insulation body coupled to an end of said second fuse wire;

a third column, one end thereof coupled to an end of said insulation body, another end of said third column coupled to a second cap, said third column wound around with a third fuse wire at intervals, and one end of said third fuse wire coupled to said second cap; and a second ring provided on outsides of said insulation body with said second fuse wire and with said third column, another end of said third fuse wire coupled to said second ring.

2. The fuse according to claim 1, wherein a melting point of said second fuse wire is lower than that of said first fuse wire.

3. The fuse accord to claim 2, wherein a conducting wire is respectively provided on outer sides of said first cap and second cap.

4. The fuse according to claim 1, wherein said first column, first cap, second fuse wire, first ring, insulation body, third column, second cap and second ring are packaged by means of SMD (surface-mount technology).

* * * * *